US005718523A

United States Patent [19]

Shiina et al.

[11] Patent Number: 5,718,523

[45] Date of Patent: Feb. 17, 1998

[54] THERMAL TRANSFER PRINTING DEVICE AND METHOD

[75] Inventors: Toshihito Shiina; Takehito Kobayashi; Hajime Isono, all of Yamanashi-ken, Japan

[73] Assignee: Nisca Corporation, Yamanashi-Ken, Japan

[21] Appl. No.: 738,879

[22] Filed: Oct. 28, 1996

Related U.S. Application Data

[62] Division of Ser. No. 331,135, Oct. 28, 1994, Pat. No. 5,636,928.

[30] Foreign Application Priority Data

Oct. 28, 1993 [JP] Japan ..... 5-292757
Oct. 28, 1993 [JP] Japan ..... 5-292759

[51] Int. Cl.[6] ..... B41J 2/315

[52] U.S. Cl. ..... 400/120.04; 400/636.1; 400/582; 400/708; 347/177

[58] Field of Search ..... 400/120.02, 120.03, 400/120.04, 120 MP, 582, 636, 636.1, 636.2, 708, 711, 120.16, 120.17; 347/172, 174, 176, 177, 215, 218, 197, 198

[56] References Cited

U.S. PATENT DOCUMENTS

| | | | |
|---|---|---|---|
| 4,620,807 | 11/1986 | Polit | 400/649 |
| 4,667,208 | 5/1987 | Shiraki et al. | 347/177 |
| 4,860,028 | 8/1989 | Ogawa | 400/234 |
| 4,960,338 | 10/1990 | Sheldon | 400/636.1 |
| 5,021,804 | 6/1991 | Nozawa et al. | 400/636 |
| 5,266,969 | 11/1993 | Mochizuki | 400/120.04 |
| 5,270,735 | 12/1993 | Fiscella et al. | 347/172 |
| 5,294,203 | 3/1994 | Williams | 400/234 |
| 5,325,114 | 6/1994 | Fogle et al. | 347/220 |
| 5,584,589 | 12/1996 | Adkins et al. | 400/636 |

FOREIGN PATENT DOCUMENTS

| | | | |
|---|---|---|---|
| 61-199969 | 9/1986 | Japan | 400/649 |
| 61-237657 | 10/1986 | Japan | 400/120 MP |
| 1-036471 | 2/1989 | Japan | 400/120 MP |
| 2-086472 | 3/1990 | Japan | 400/636.3 |
| 2-303872 | 12/1990 | Japan | 400/636.3 |
| 3-019886 | 1/1991 | Japan | 400/120 MP |
| 3-67675 | 3/1991 | Japan | 400/636.1 |

*Primary Examiner*—David A. Wiecking
*Attorney, Agent, or Firm*—Kane,Dalsimer,Sullivan, Kurucz, Levy, Eisele and Richard, LLP

[57] ABSTRACT

A thermal transfer printer for printing images and patterns on a card with thermally transferable color inks while moving the card back and forth in such a state that the card is held and urged against a thermal print head through an ink ribbon by capstan and platen rollers. In printing, the card is first forwarded over a print-starting point, and then, reversed until the leading end thereof arrives at an overrun stop point prescribed behind the print starting point, and thereupon, moved forward until the leading end of the card is positioned at the print-starting point to start printing. Thus, mechanical clearance giving rise to backlash essentially possessed of mechanical elements can be completely eliminated, thereby enabling remarkably high-quality color images to be produced.

12 Claims, 9 Drawing Sheets

THERMAL TRANSFER PRINTING DEVICE AND METHOD

This is a division of application Ser. No. 08/331,135, filed Oct. 28, 1994, now U.S. Pat. No. 5,636,928 issued Jun. 10, 1997.

BACKGROUND OF THE INVENTION

1. Field of the Invention

This invention relates to a thermal transfer printing device and method for thermally transferring thermal transfer inks to a recording medium to produce images on the recording medium by exothermically driving a thermal print head, and more particularly to a thermal transfer printer and method capable of rationally moving and accurately positioning a card-like recording medium at a printing position.

2. Description of the Prior Art

In a printer for producing images using an ink ribbon applied with a thermal transfer ink to be thermally transferred to a recording medium by exothermically driving an array of heating resistance elements of a thermal print head, the quality of reproduced images depends upon the accuracy of positioning the recording medium relative to the thermal print head located at a printing position.

For example, when producing colored patterns and/or photographs on a recording medium such as a credit card and an identification card by use of three primary color inks of yellow, magenta and cyan, it is necessary to move the card back and forth relative to the printing position to perform a single colored printing three times. Therefore, by severely controlling the movement of the card so as to accurately position the card at the printing position, high-quality multi-colored images can be produced.

One example of the conventional thermal transfer printers is disclosed in Japanese Patent Application Public Disclosure No. HEI 3(1991)-275362(A). As schematically illustrated in FIG. 1, this prior art printer performs printing by the steps of first feeding a card C as a recording medium from a card stacker 1 onto a moving bed 2 located in a printing portion, moving down and bringing a thermal print head 3 into contact with the card C through an ink ribbon 4 having a thermal transfer ink, and exothermically driving the thermal print head 3 to thermally transfer the thermal transfer ink on the ink ribbon 4 while moving the card C on the moving bed 2 relative to the print head 3, thereby producing images on the card C.

In this prior art printer, during the course of printing, the moving bed 2 carrying the card C is moved by rotating a feed screw **2*a* along guide rods 2*b* in the sideways direction d2 perpendicular to the direction d1 in which the card C is transported from the card stacker 1 to the printing portion. Accordingly, this prior art printer necessitates a card transporting mechanism including the card stacker, a card moving mechanism for reciprocating the bed 2** in the sideways direction, and a head driving mechanism for vertically moving the thermal print head several times to produce one colored print output, thus resulting in a large overall size.

Another version of the printer further requires card holding means for securing in position the card C on the moving bed 2 as mentioned above, as typically proposed by Japanese Patent Application Public Disclosure No. HEI 3(1991)-278976(A). Installation of such card holding means 6 as indicated by imaginary lines in FIG. 1 adds to the size and complexity of the printer.

The aforementioned prior art printers each are provided on the card discharge side thereof with a card coating unit 7 for finally coating the card surface with a transparent plastic layer 8. The plastic layer 8 is fusible and thermally transferred to the card surface by moving downward and exothermically driving a thermal print head 9 in contact with the card C through the plastic layer 8. In this card coating unit 7, there is no necessity for accurately positioning the card C relative to the thermal print head 9 because the transparent plastic layer 8 may be roughly stuck on the card surface.

The printer for producing high-quality multi-colored images is required to be highly controlled to position the card relative to the print head on the order of several micron meters corresponding to the size of each of dots or pixels forming the images. However, a driving system for moving the card relative to the print head usually comprises mechanical elements including gears, feed screws, pinions, racks and/or toothed belts, Which inevitably bring about backlash causing obstruction to the accurate positioning of the card relative to the print head. The idea of eliminating such minute mechanical clearance of the mechanical elements to the fullest possible extent has in no way been embodied in conventional thermal printers.

OBJECT OF THE INVENTION

An object of this invention is to provide a thermal transfer printing device and method capable of effectively producing high-quality multi-colored images with a high accuracy by use of a simple controlling system.

Another object of this invention is to provide a simple, high-performance and handy thermal transfer printing device in which a recording medium can be rationally transported and accurately moved back and forth relative to a printing portion in the device to produce high-quality multi-colored images.

Still another object of this invention is to provide a thermal transfer printing device and method capable of completely eliminating mechanical clearance or backlash caused by mechanical elements constituting a card transporting system, thus positioning the recording medium at a printing position with a high accuracy to produce high-quality multi-colored images on the recording medium.

SUMMARY OF THE INVENTION

To attain the objects described above according to this invention, there is provided a thermal transfer printing device comprising a thermal print head stationarily located at a printing position, and a drive unit including a platen roller opposite to the thermal print head, capstan rollers disposed beyond and behind the platen roller so as to move back and forth a card in a card-transporting direction, a supporting frame for securing the platen and capstan rollers, and actuating means for urging the platen roller against the thermal print head during a printing operation.

The cards as a recording medium are fed from a card stacker one by one and transported to the printing position. At the printing position, the card is retained between the capstan rollers and pressed against the thermal print head through a ribbon with thermally transferable material such as color inks by operating the driving unit when performing a printing operation. Then, the thermal print head is exothermically driven while moving the card and ink ribbon at the same speed, thereby producing images on the card. The card is returned toward a print-starting point as each monochromic printing is completed. At this time, the card is moved backward to an overrun stop point prescribed behind the print-starting point, and then, forwarded to be positioned at the print-starting point, as a result of which mechanical clearance giving rise to backlash essentially possessed of mechanical elements constituting the driving unit can be fully eliminated, thus enabling very high-quality multi-color printing.

Since the card is moved back and forth around the printing position in a card-transporting direction, a system for transporting and moving back and forth the card can be constructed rationally, consequently making the printer and its controlling system simple in structure and small in size.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not limitative of the present invention.

Figure 1:
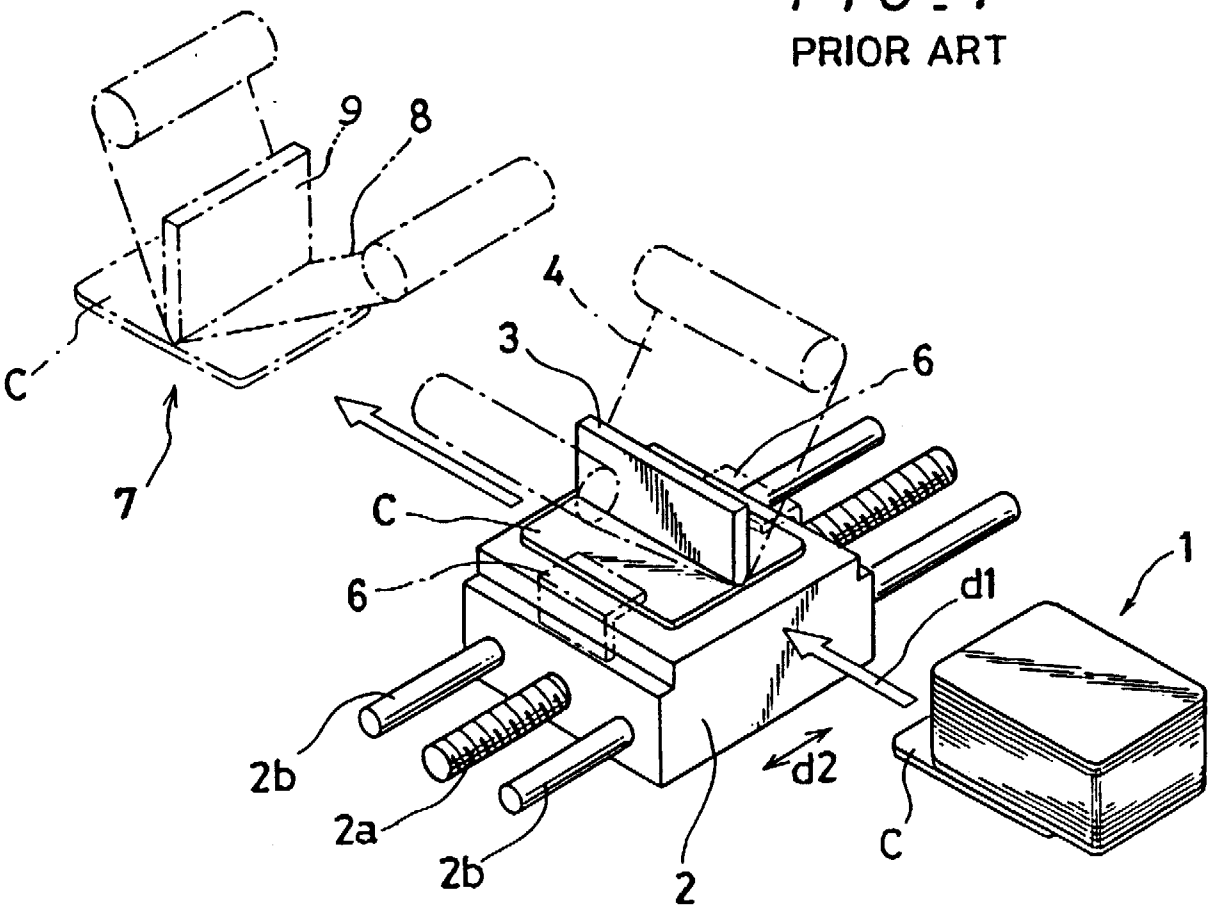
FIG. 1 PRIOR ART
FIG. 1 is a schematic view showing the principal printing portion in a prior art thermal transfer printer.
Figure 2:
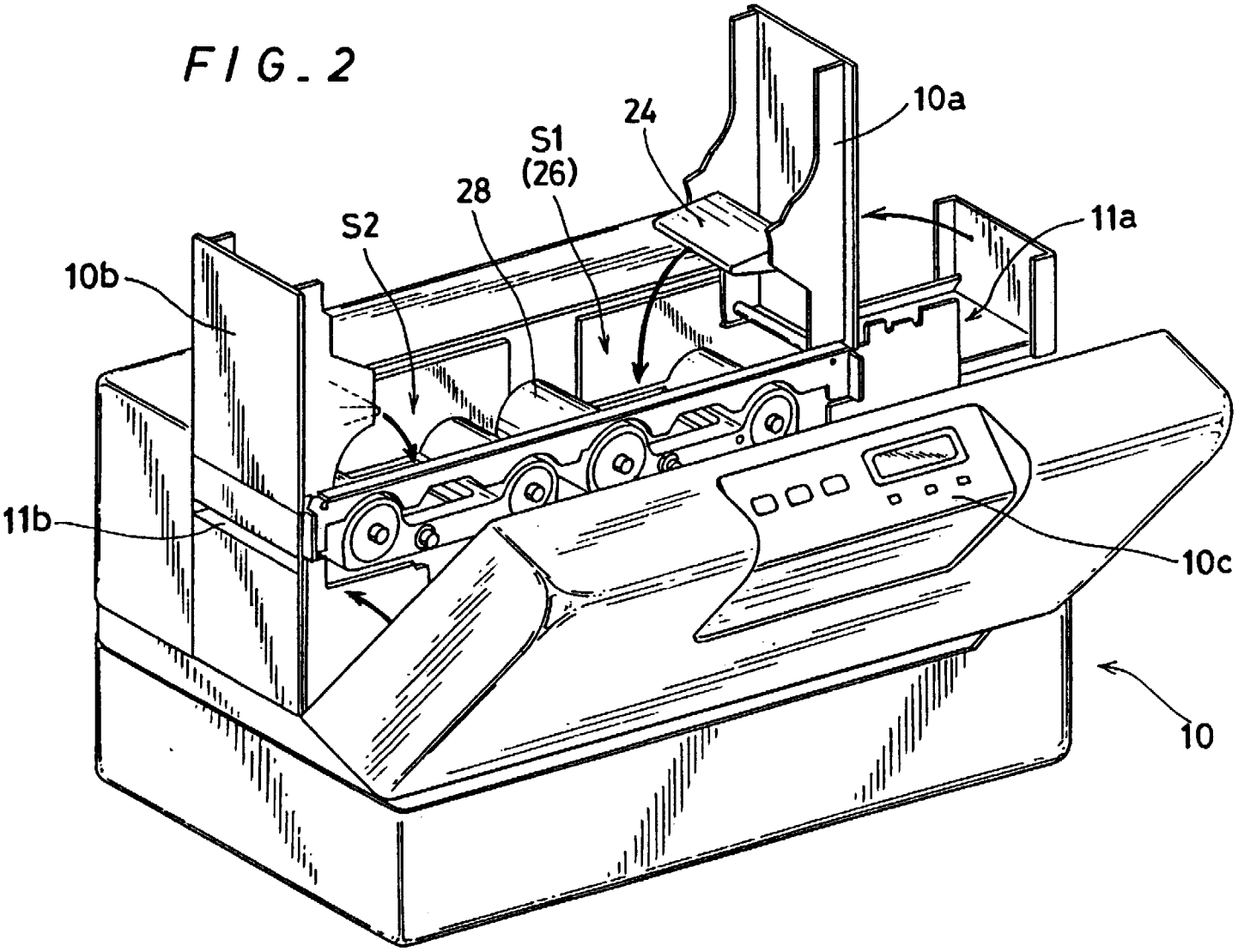
FIG. 2 is a perspective view showing one embodiment of a thermal transfer printer according to this invention.

A thermal transfer printer according to this invention is adapted for producing images on a recording medium such as cards of various kinds with a thermally transferable material by a thermal transferring method and has at least one printing portion. In one embodiment illustrated in FIG. 2 and FIG. 3, the printer comprises a first printing section S1 in which photo-quality images of multiple gradations are produced by using dye-sublimation color inks as the thermally transferable material, and a second printing section S2 in which two-gradation images such as character and line patterns are produced by using a monochromic thermal wax-transfer ink, and/or hologram print films are thermally transferred to the cards. In the second printing section S2, the card thus printed in the first printing section S1 is finished by being coated with a transparent protective layer. Thus, although the first and second printing sections S1 and S2 employ the different thermal transfer ribbons as mentioned above, operation systems for these printing sections are substantially identical with each other. Incidentally, the printer of this type may be fundamentally composed of one printing section. From the standpoint of this fact, the first printing section S1 will be mainly explained hereinafter. Furthermore, although a card material applicable for credit cards and identification cards is herein used as a recording medium to be printed, this should not be understood as limitative.

Figure 4:
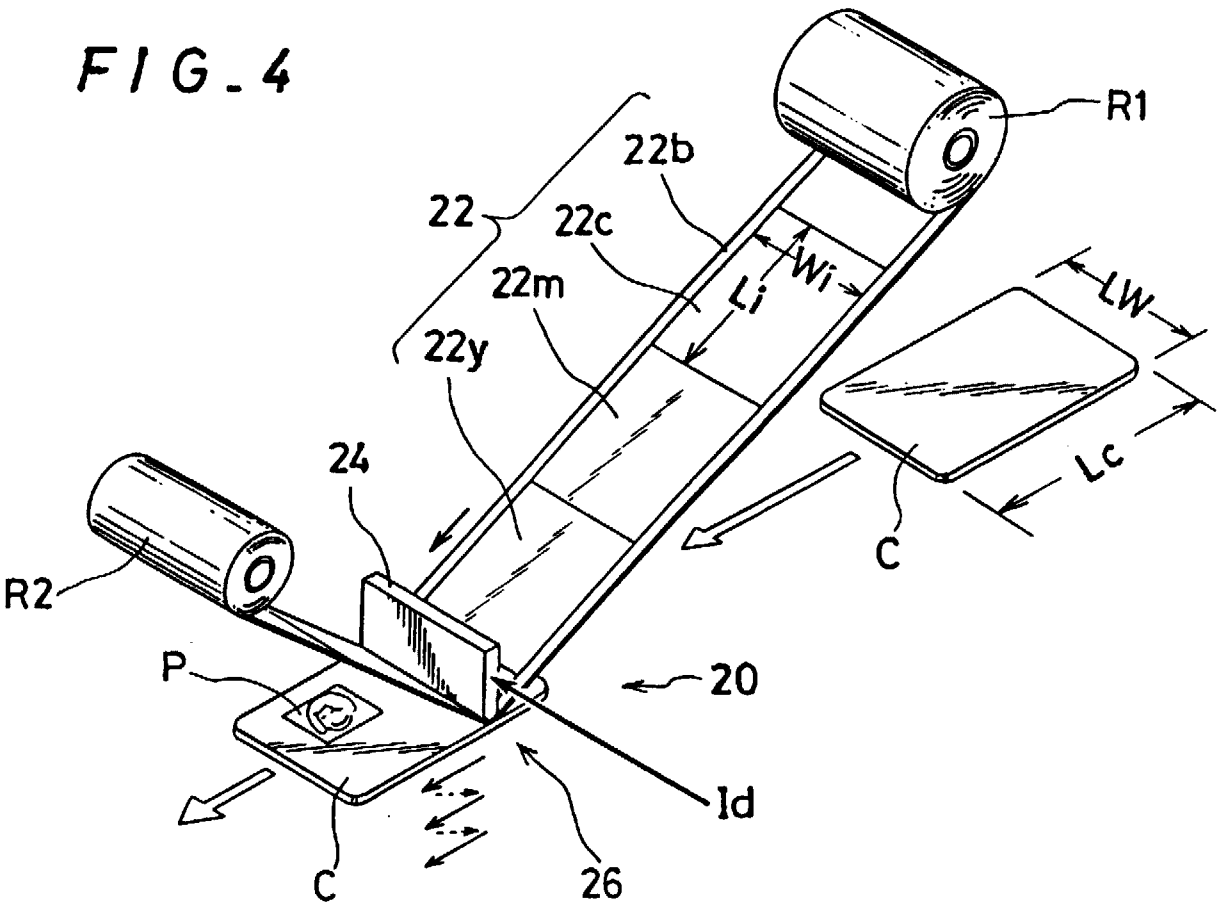
FIG. 4 is an explanatory diagram schematically showing the printing portion of the printer of this invention.

The aforementioned first and second printing sections S1 and S2 are defined inside a printer body 10. One or more blank cards C are stacked within a medium supply unit (card stacker) **11*a* located on a card entrance formed on one side of the printer body 10 and fed one by one toward the first printing section S1 through a transport passage TP. In the first printing section S1, a desired image P is printed on the card C as shown in FIG. 4, and then, transported to the second printing section S2. In the second printing section S2, the card is subjected to second printing and/or surface treatment, and sent out through an exit port 11*b* formed in the other side of the printer body 10. In the drawings, reference numerals 10*a* and 10*b* denote lid covers, and 10*c*** denotes a console panel.

In printing in the first printing section S1, there are used, as the thermally transferable material, dye-sublimation thermal transfer color inks **22*y*, 22*m* and 22*c* of three primary colors, namely, yellow (Y), magenta (M) and cyan (C) as conceptually illustrated in FIG. 4**. With these colors, any color can be created by a subtractive color mixture method, but the number and kind of such colors are not specifically limited in this invention. For instance, a black ink may be added. It is a matter of course that at least one thermal wax-transfer ink may be used as the thermally transferable material.

In the first printing section S1, there is installed a first printing unit 20 including a first transfer ribbon 22 applied with the aforesaid thermal transfer color inks **22*y*, 22*m* and 22*c* and a thermal print head 24 which is stationarily located at a printing position in a printing operation and exothermically operates to thermally transfer the color inks to the ribbon 22**, consequently producing colored images on the card C.

By accurately positioning the card C relative to the thermal print head 24 to a very high degree in the first printing section S1, photorealistic full-color images can be printed with the aforesaid dye-sublimation color inks. To be specific, to produce very high-quality images, the card C which must be moved back and forth for at least three times relative to the thermal print head 24 (print-starting point) until the printing of the desired image is completed. However, since the card C is usually moved by mechanical elements such as gears, toothed belts and pinion-rack means, it could not be positioned with accuracy at the print-starting point due to backlash of such mechanical elements when being returned to the point-starting point each time a monochromic printing is performed.

The printer according to this invention possesses a mechanism for accurately positioning the card at the print-starting point, which comprises a driving unit including actuating means for controlling the movement of the card relative to the print head 24 to a high degree. The structure of the driving unit will be described in detail hereinafter.

Figure 3:
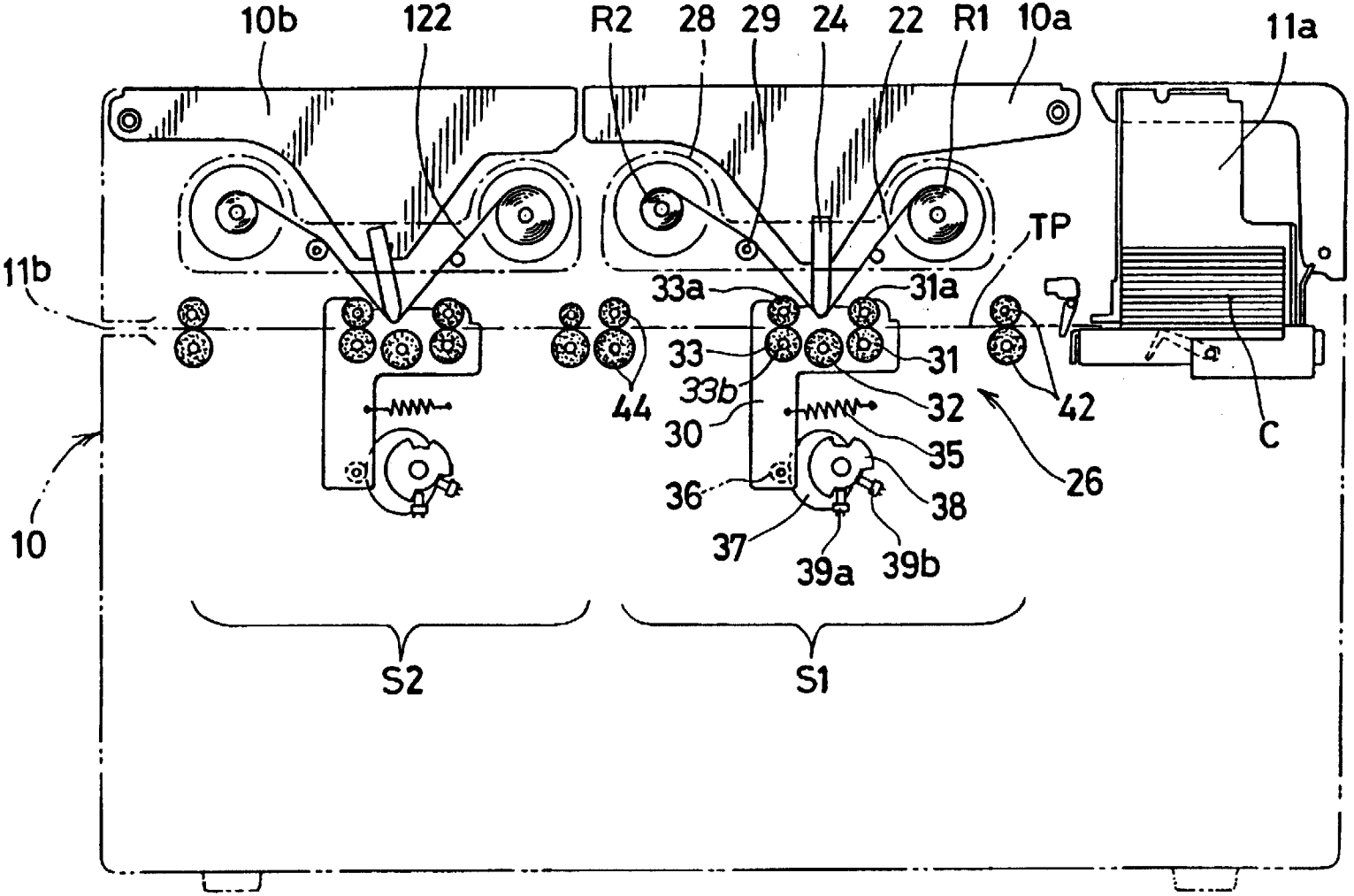
FIG. 3 is a schematic side view showing the internal mechanism of the printer of FIG. 2.
Figure 5:
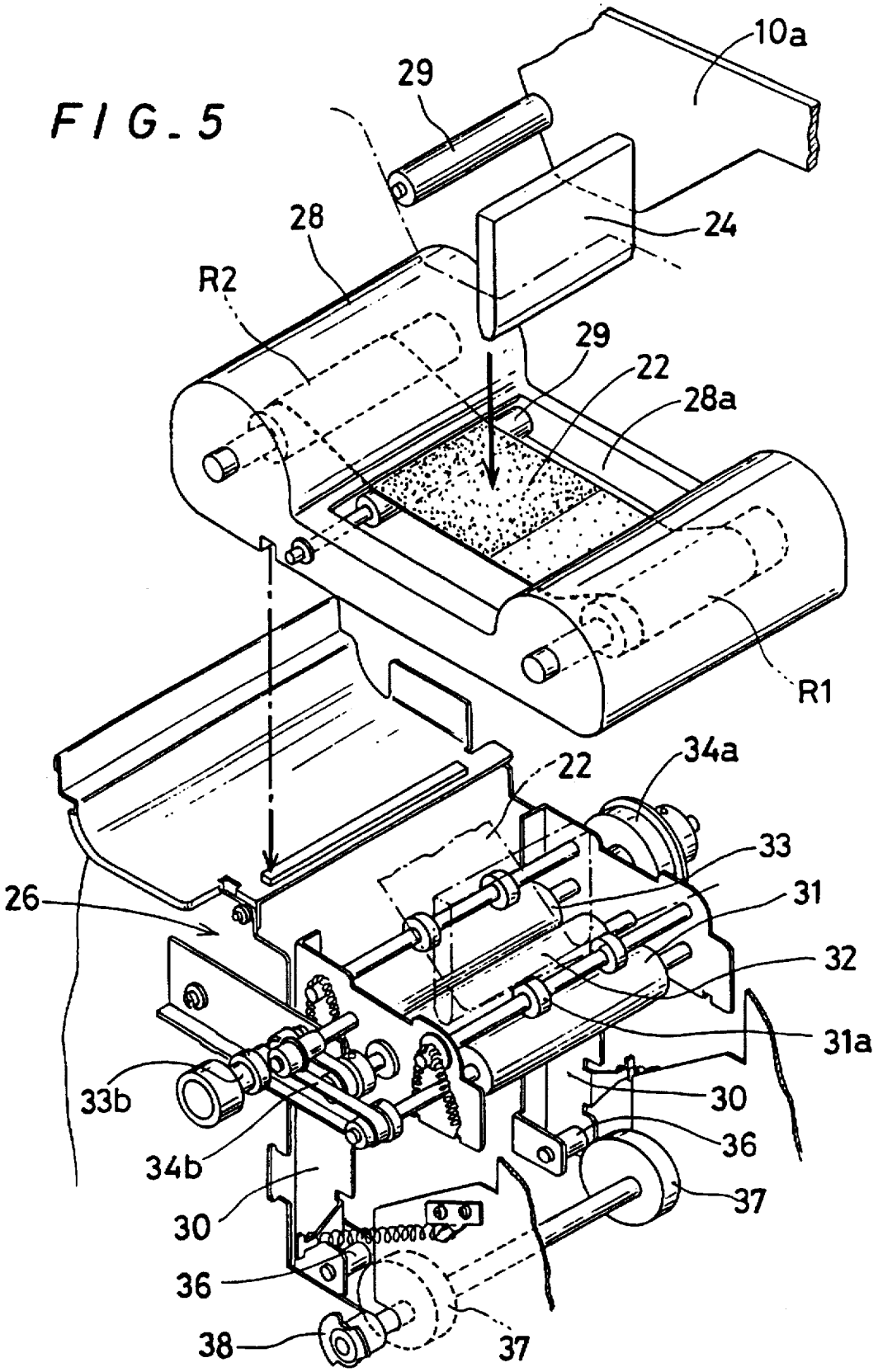
FIG. 5 is a fragmentary view in partial section showing the printer according to this invention.

The driving unit of the first printing section S1 includes an entry-side first capstan roller 31, a platen roller 32, and an exit-side second capstan roller 33, which are arranged in line along the transport passage TP, as shown in FIG. 3 and FIG. 5. The capstan rollers 31 and 33 are in resilient contact with pinch rollers 31*a* and 33*a*, respectively.

The second capstan roller 33 is retained by a rotary shaft 33*b* which is driven to rotate by a drive means 34*a*. The rotation of the rotary shaft 33*b* is transmitted to the rollers 31 and 32 through transmitting means 34*b* so as to synchronously rotate the rollers 31 to 33. The drive means 34*a* includes a pulse motor capable of minutely determining its rotational quantity in accordance with the number of current pulses supplied thereto, thus severely controlling the movement of the card C with a high accuracy.

The paired capstan rollers 31 and 31*a*, platen roller 32, and paired capstan rollers 33 and 33*a* are retained by actuating means including a substantially L-shaped supporting frame 30 having a horizontal portion 30*h* and a vertical portion 30*v*. The supporting frame 30 is pivoted on the rotary shaft 33*b* of the capstan roller 33 so as to rockingly rotate about the rotary shaft 33*b*, and constantly urged by a spring 35 so as to force up the horizontal portion 30*h*. The supporting frame 30 is provided at the lower end of the vertical portion 30*v* with a cam follower 36. Opposite to the cam follower 36, there is disposed an elliptic cam 37 united with an angle detection plate 38, so that the horizontal portion 30*h* of the supporting frame 30 is rockingly moved around the rotary shaft 33*b* with the rotation of the elliptic cam 37.

The angle detection plate 37 has notches 38*a* and 38*b* which activate and deactivate sensors 39*a* and 39*b* to perceive the rotational posture of the cam 37.

Along the transport passage TP, there are arranged two paired transport rollers 42 and 44, a first card sensor Sw1 in the rear of the transport rollers 42, a second card sensor Sw2 in front of the capstan roller 31 and a third card sensor Sw3 in the rear of the capstan roller 33.

Figure 6A:
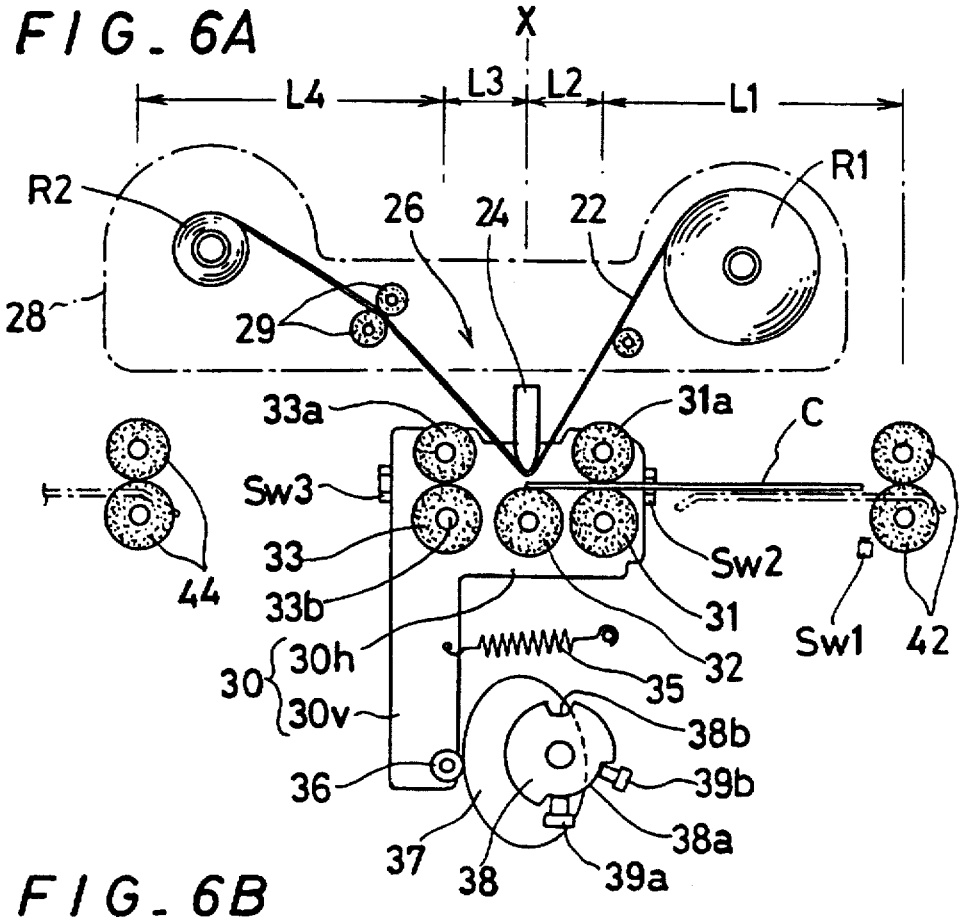
FIGS. 6A and 6B are schematic side views explanatory of the printing process of the printer of this invention.

The intervals at which the rollers 42, 31, 32, 33 and 44 are respectively separated as shown in FIG. 6A are determined by the following formulae:

$$L1 \leqq L < (L1+L2) \quad (1)$$

$$L4 \leqq L < (L3+L4) \quad (2)$$

wherein, L stands for the length of the card C; L1 for the interval between the entry-side transport rollers 42 and the capstan roller 31; L2 for the interval between the capstan roller 31 and the platen roller 32; L3 for the interval between the plate roller 32 and the capstan roller 33; and L4 for the interval between the capstan roller 33 and the exit-side transport rollers 44.

As is understood from the formulae (1) and (2) above, when the leading end of the card C fed from the card supply unit 11*a* located on the right side of the transfer rollers 42 is fed to between the capstan roller 31 and the platen roller 32, the rear end of the card C is released from the transfer rollers 42. Likewise, when the rear end of the card C is still left between the platen roller 32 and the capstan roller 31, the card C is nipped between the exit-side transfer rollers 44 so as to be discharged out from the printing portion.

Figure 6B:
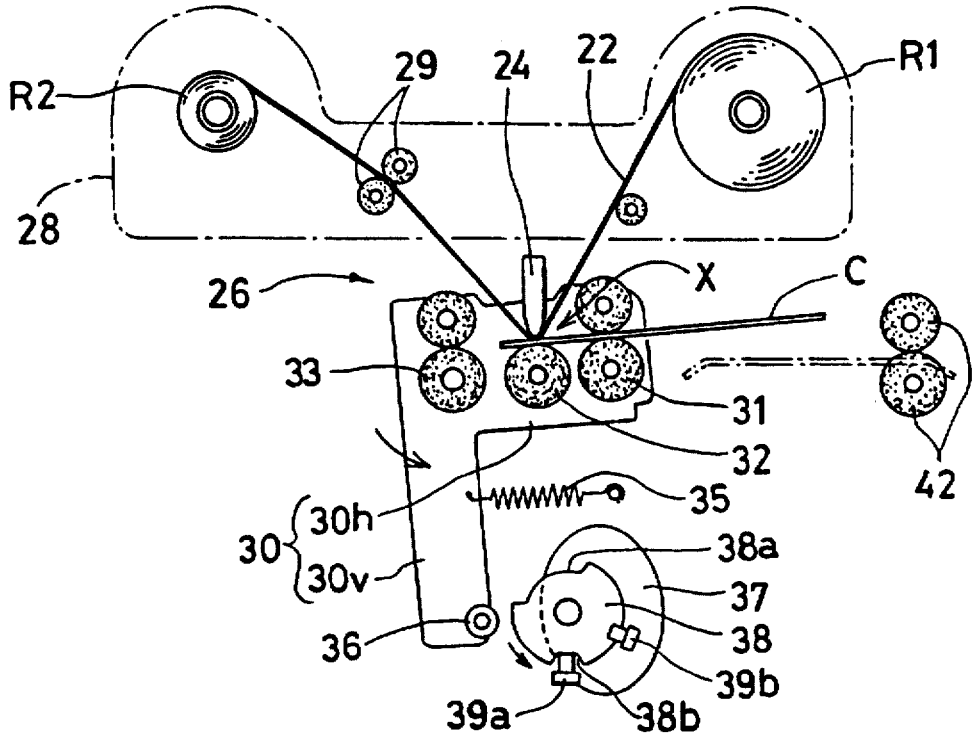

When the front end of an effective printing area prescribed on the card C arrives at the printing point X at which the thermal print head 24 faces the platen roller 32 in the state shown in FIG. 6A, the cam 37*a* rotates to force the horizontal portion 30*h* of the supporting frame 30 upward to bring the card into contact with the print head 24 through the transfer ribbon 22 as shown in FIG. 6B. Then, the card C is forwarded together with the transfer ribbon 22 by rotating the rollers 31, 32 and 33 at the same speed while being kept in contact with the print head 24 and exothermically driving the print head to generate heat. As a result, the ink on the transfer ribbon 22 is thermally transferred to the card C, thus producing the desired image pattern on the card. Upon completion of printing with one of color inks, the cam 37 rotates so as to lower the horizontal portion 30*h* of the supporting frame 30, thereby separating the card from the print head 24. Thereupon, the rollers 31, 32 and 33 are reversed to return the card to the status quo ante as illustrated in FIG. 6A.

The card transporting state of FIG. 6A and the printing state of FIG. 6B are distinguishable by detecting the notches 38*a* and 38*b* formed in the angle detection plate 37 by the sensors 39*a* and 39*b*. That is to say, when both the sensors 39*a* and 39*b* detect the notch 38*a*, the driving unit assumes the card transporting state of FIG. 6A, and when the sensor 39*b* detects the notch 38*b*, the driving unit assumes the printing state of FIG. 6B.

The elliptic cam 37 is eccentrically supported so that the supporting frame 30 rockingly moves at a high speed when the platen roller 32 is separate from the thermal print head 24 and slows down immediately before the platen roller 32 comes in touch with the print head 24. Thus, the supporting frame 30 with the rollers 31, 32 and 33 can be rationally operated, and the platen roller 32 comes in non-shock contact with the print head 24.

The same procedure is repeated three times equal to the number of colors to be printed. When the printing with the three primary color inks is finished, the card C is sent out through the exit port 11*b* by the transport rollers 44.

According to this invention, the accurate positioning of the card C at the printing point X in the card transporting state shown in FIG. 6A can be attained on the order of several micron meters corresponding to the size of dot or pixel. To be concrete, the printer of this invention has a function of completely absorbing mechanical clearance such as backlash essentially possessed of meshed gears or other mechanical elements, thus enabling remarkably minute images to produce on the recording medium. This will be described in detail hereinafter.

Figure 7:
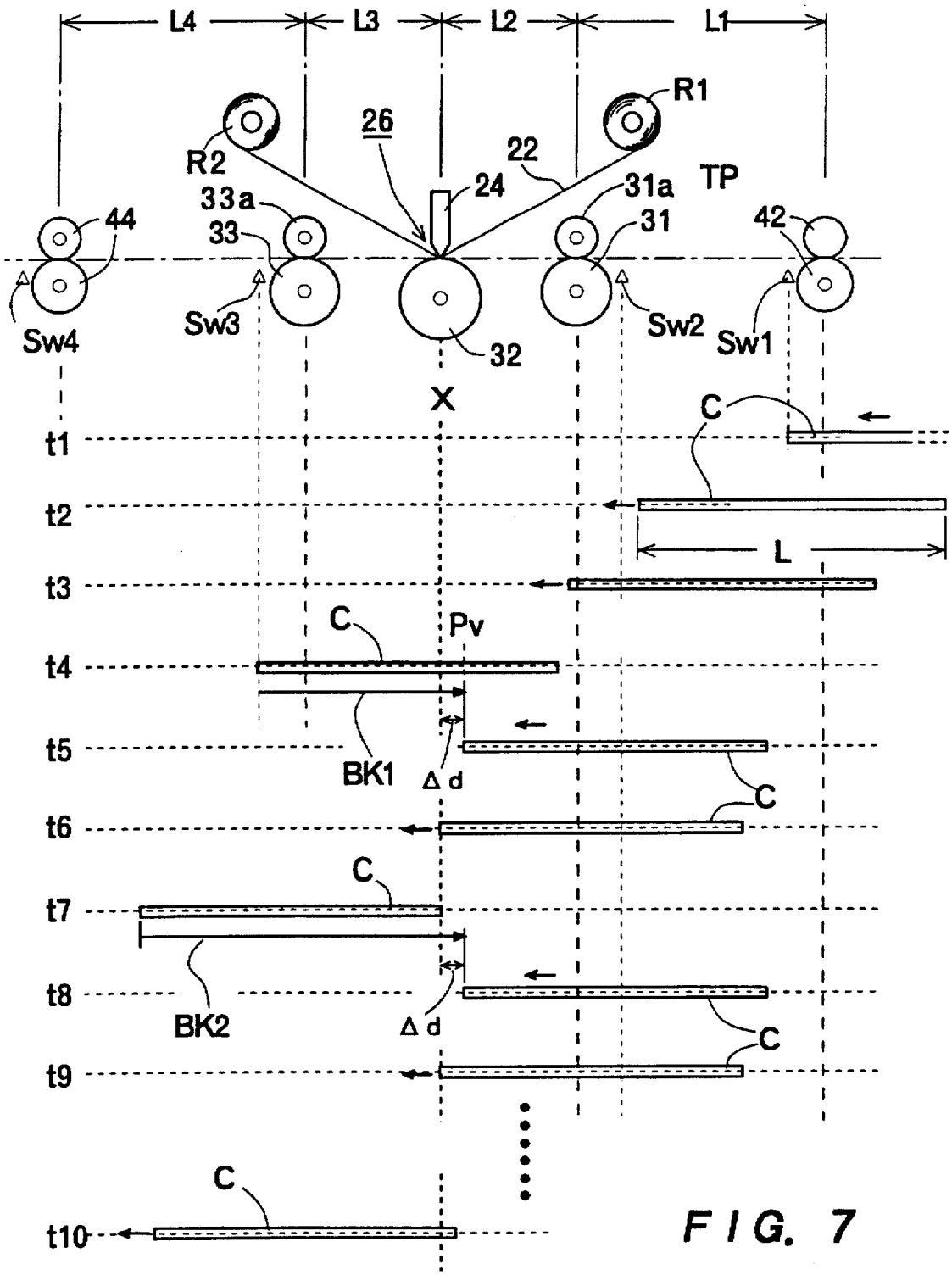
FIG. 7 is an explanatory diagram showing the sequence of operation in transporting a card in printing according to this invention.

The sequence of operation in performing multi-color printing at the times t1 to t10 is schematically shown in FIG. 7. The intervals L1, L2, L3 and L4 between the respective rollers 42, 31, 32, 33 and 44 bearing the card C are expressed by the formulae (1) and (2) described above. Incidentally, at the times from t1 to t5 and from t8 to t9, the driving unit including the rollers 42, 31, 32, 33 and 44 assumes the card transporting state in which the platen roller 32 is separated from the thermal print head 24 as illustrated in FIG. 6A, and at the times from t6 to t7, the driving unit assumes the printing state in which the platen roller 32 is in contact with the thermal print head 24 through the card C and thermal transfer ribbon 22 as illustrated in FIG. 6B.

The card C fed from the card stacker located on the right side of the transport rollers 42 in FIG. 7 is transported toward the printing portion 26 by the transport rollers 42. When the leading end of the card C is detected by the sensor Sw1 at t1, the rollers 31, 32 and 33 start to rotate in the card-transporting state shown in FIG. 6A. When the leading end of the card C is detected by the sensor Sw2 at t2, the card C moving at a high speed to this point slows down so as to enter into between the capstan rollers 31 and 31*a* without undergoing collisional shocks.

When the card C is nipped between the rollers 31 and 31*a* at t3, it is forwarded through the printing point X until the leading end thereof is detected by the sensor Sw3 at t4. At this time, the card is released from the rollers 31 and 31*a*, but nipped between the rollers 33 and 33*a*.

When the leading end of the card C is detected by the sensor Sw3 at t4, the card C starts to move backward as indicated by the arrow BK1. The reverse movement of the card C continues until the leading end of the card C arrives at an overrun stop point Pv defined between the rollers 31 and 32, under the control of the pulse motor incorporated in the drive means 34*a*, which can minutely determine its rotational quantity in accordance with the number of current pulses supplied thereto as was touched on earlier.

The overrun stop point Pv is prescribed at the distance Δd from the print-starting point X in the reverse feeding direction, namely, behind the roller 31 relative to the card-transporting direction, and may be arbitrarily determined in accordance with the number of current pulses supplied to the drive means 34*a*.

Thus, the card C stops where the leading end thereof is exactly positioned at the overrun stop point Pv behind the print-starting point X at t5, and then, start to move forward. When the leading end of the card C arrives at the print-starting point X at t6, the driving unit is operated to force the rollers 31, 32 and 33 upward to bring the card C into contact with the thermal print head 24 through the transfer ribbon 22. Upon this, the card C moves forward together with the transfer ribbon 22 until the rear end thereof passes through the print-starting point X at t7, so that the entire printing surface of the card C is subjected to a printing with one color. At t7, the leading end of the card C must be positioned beyond the sensor Sw3. Thereupon, the platen roller 32 is lowered to separate the card C from the thermal print head 24, and then, the card C is moved backward by the length indicated by the arrow BK2 until the leading end of the card C arrives at the overrun stop point Pv at t8 similarly to the time t5. Thereafter, the card C is forwarded to the print-starting point X at 9, and then, the steps from t7 to t9 are repeated until the printing with the last color ink in one color image is completed. When the desired colored image is obtained, the card C is sent out from the printing portion 26 at t10.

As is described above, the card C is first forwarded until the leading end thereof is detected by the sensor Sw3 beyond the print-starting point X, and then, moved backward until the leading end arrives at the overrun stop point Pv behind the print-starting point X, and thereupon, forwarded until the leading end arrives at the print-starting point X, thus completely eliminating the mechanical clearance bringing about backlash essentially possessed of the mechanical elements constituting the driving unit. Consequently, very high-quality colored images formed of color pixels fully registered can be produced.

Figure 8:
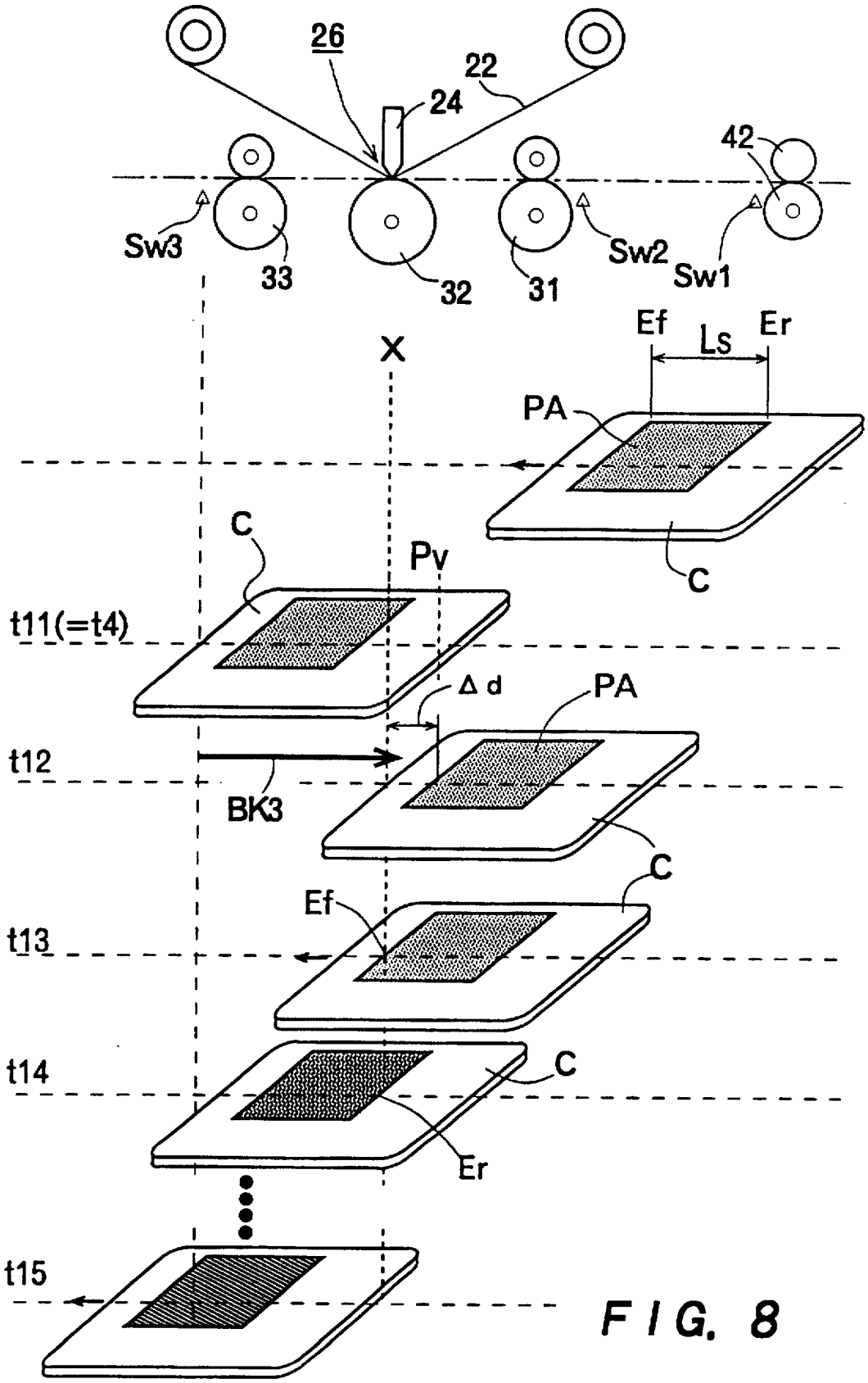
FIG. 8 is an explanatory diagram showing the sequence of operation in transporting the card in another embodiment of this invention.

In the foregoing embodiment, the positioning of the card relative to the print-starting point X is carried out on the basis of the leading end of the card by the way of example. However, it will be understood from the practical point of view that the card C may be moved back and forth on the basis of the front end or rear end of the effective printing area to be printed, which is prescribed on the surface of the card. As shown in FIG. 8, the effective printing area PA defined by a length Ls with a front end Ef and a rear end Er must be smaller than the whole surface of the card C. That is, the card C may move back and forth by the length Ls plus the distance Δd from the print-starting point X to the overrun stop point Pv.

To be more specific, the card C transported from the card stacker to the printing portion is first forwarded until the leading end of the card C is detected by the sensor Sw3. The process up to this point is substantially similar to the process up to the time t4 in the foregoing embodiment shown in FIG. 7. When the leading end of the card C is detected by the sensor Sw3, the card C is reversed until the front end of the printing area PA arrives at the overrun stop point Pv as indicated by the arrow BK3 at t12. Thereupon, the card C is forwarded until the front end Ef arrives at the print-starting point X at t13. At the same time, the platen roller 32 is forced upward to bring the card C into contact with the thermal print head 24 through the thermal transfer ribbon 22 to begin a printing operation. The printing operation is stopped when the rear end Er of the effective printing area PA reaches the print-starting point X at t14, and then, the platen roller 32 is separated from the print head 24. At this time, if the leading end of the card C does not reach the sensor Sw3, the card C is further moved forward until being detected by the sensor Sw3. After detecting the leading end of the card C by the sensor Sw3, the same processes from t11 are repeated until the desired colored image is produced. When the desired printing is completed, the card is sent out from the printing portion at t15.

Therefore, the entry-side transport roller 42, first capstan roller 31, platen roller 32, second capstan roller 33 and exit-side transport roller 44 are so arranged as to satisfy the following formulae:

$$L1 \leqq Ls < (L1+L2) \quad (3)$$

$$L4 \leqq Ls < (L3+L4) \quad (4)$$

wherein, Ls stands for the length of the effective printing area on the card C; L1 for the interval between the rollers 42 and 31; L2 for the interval between the rollers 31 and 32; L3 for the interval between the rollers 32 and 33; and L4 for the interval between the rollers 33 and 44.

According to this embodiment, the card C can be rationally transported, thus increasing the printing efficiency and speed. Although the card transporting operation in this embodiment is practiced on the basis of the front end Ef of the effective printing area PA, but it can of course be supervised on the basis of the rear end Er of the same.

Furthermore, the printer according to the present invention has a mechanism capable of lessening collisional shocks and irregularity in feeding speed of the card, which are possibly caused when the first capstan rollers nip the card fed from the card supply unit.

Figure 9:
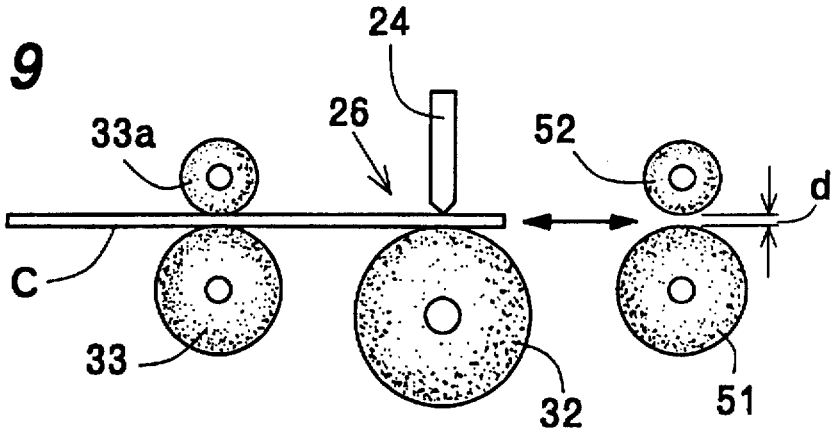
FIG. 9 is a schematic side view showing a modified form of capstan rollers in the printer of this invention.

As illustrated in FIG. 9, merely by separating a pinch roller 52 from a capstan roller 51 by an interval d somewhat smaller than the thickness of the card C, the collisional shocks which the card undergoes when entering into between the capstan rollers can be somewhat lessened.

Figure 10:
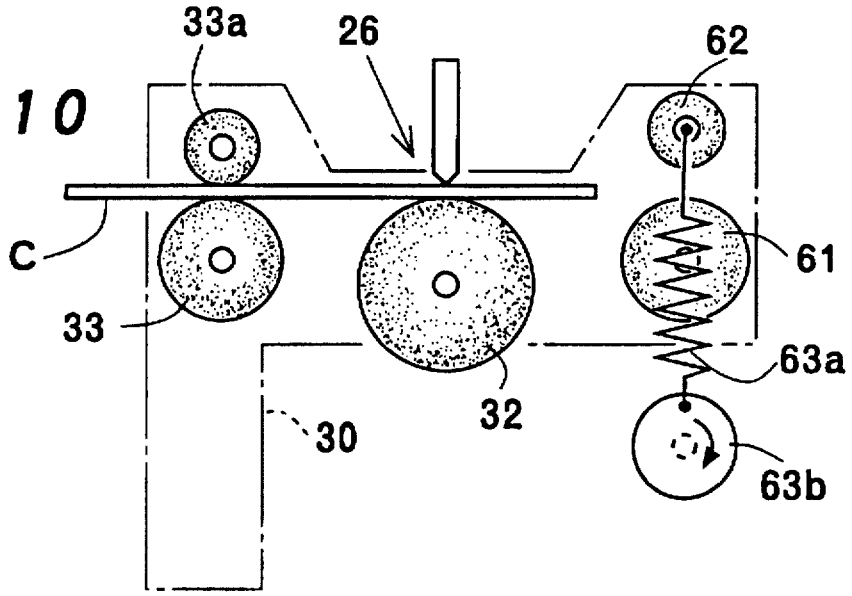
FIG. 10 is a schematic side view showing another modified form of the capstan rollers of this invention.

Such inconveniences can be more effectively lessened by using an arrangement as shown in FIG. 10, in which a pinch roller 62 opposite to a stationary capstan roller 61 is movably supported and urged toward the capstan roller 61 by a spring 63*a*. The tractive force of the spring 63*a* can be controlled by rotating a cam wheel 63*b*. Thus, the nipping pressure exerted to the card C is weakened when the card C enters into between the capstan roller 61 and pinch roller 62, so that the card can little undergo collisional shocks.

Although this embodiment employs the cam wheel 63*b* shaped in a disk for varying the tractive force of the spring 63*a*, it goes without saying that a lever, electric actuator or other possible driving means may be used in place of the cam wheel.

Figure 11:
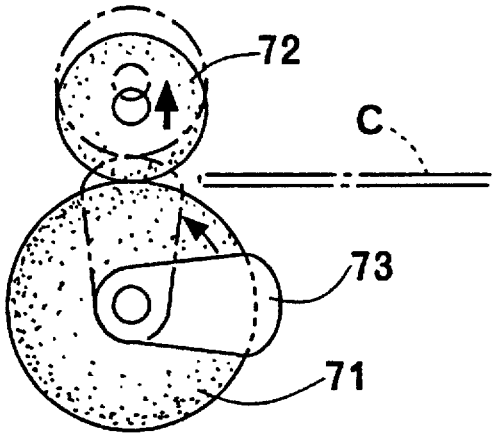
FIG. 11 is a schematic side view showing still another modified form of the capstan rollers of this invention.

A mechanism shown in FIG. 11 is another modified form capable of adjusting the distance between a capstan roller 71 and a pinch roller 72. In this mechanism, the movable pinch roller 72 is resiliently pressed against the stationary capstan roller 71 under normal conditions, but when the card enters into between the capstan and pinch rollers, the pinch roller 72 is forced upward by rotating a lever cam 73, thereby to mitigate the collisional shocks which the card C undergoes.

According to these embodiments shown in FIG. 9 through FIG. 11, the efficiency of transporting the card can be remarkably increased, thus realizing a very high-quality color printing.

Although the foregoing embodiments are adapted to perform multi-color printing, they may be of course applied for monochromic printing. Moreover, the foregoing is descriptive of mainly the first printing section S1 as shown in FIG. 3, in which photorealistic color images are printed with multiple dye-sublimation inks. It is a matter of course that the printing device according to this invention is applicable for not only multi-color printing but also monochromic printing and thermally transferring of a hologram print film and/or a protective layer to a recording medium.

As is apparent from the foregoing description, according to the present invention, remarkably high-quality multi-colored images can be produced with a high accuracy because the recording medium such as a card can be rationally transported and accurately positioned relative to the thermal print head.

Furthermore, the thermal transfer printer according to this invention can completely eliminate mechanical clearance bringing about backlash essentially possessed of mechanical elements constituting a medium-transporting system, thus positioning the recording medium at the printing position with a high accuracy to produce high-quality multi-colored images on the recording medium.

Thus, since the card is moved back and forth around the printing position in a medium-transporting direction, the medium-transporting system can be constructed rationally, consequently making the printer and its controlling system simple in structure and small in size.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A method for thermally transferring thermally transferable material to a recording medium having a leading end by use of a printer comprising a thermal print head located at a print-starting point, and a driving unit including an entry-side transfer roller, a first capstan roller, a platen roller, a second capstan roller, a sensor for detecting said recording medium, and an exit-side transfer roller, said rollers being arranged along a transport passage, which comprises the steps of:

defining an overrun stop point between said first capstan roller and said platen roller, based on the position of said recording medium detected by said sensor, forwarding said recording medium along said transport passage in a medium-transporting direction, detecting said recording medium thus forwarded, reversing said recording medium to said overrun stop point forwarding said recording medium to said print-starting point, and moving said recording medium in the medium-transporting direction while thermally transferring said thermally transferable material to said recording medium in such a state that said recording medium is brought into contact with said thermal print head through said thermally transferable material.

2. A method according to claim 1, wherein said thermal transferable material is at least one of thermally transferable inks, hologram film and protective layer.

3. A method according to claim 1, wherein said thermal transferable material is at least one of dye-sublimation color inks.

4. A method for printing images, with a plurality of thermally transferable color inks, on a card having a leading end, utilizing a printer comprising a thermal print head located at a print-starting point, and a driving unit including an entry-side transfer roller, a first capstan roller, a platen roller, a second capstan roller, a card sensor for detecting said card, and an exit side transfer roller, said rollers being arranged along a transport passage, said method comprising the steps of:

(a) forwarding said card along said transport passage in a card-transporting direction, (b) detecting said card thus forwarded, (c) defining an overrun stop point between said first capstan roller and said platen roller, based on a position of said card detected by said sensor, (d) reversing said card to said overrun stop point, (e) forwarding said card to said print-starting point, (f) moving said card while thermally transferring one of said thermally transferable inks to said card while said card is brought into contact with said thermal print head through a first one of said thermally transferable inks, and (g) sequentially repeating said reversing (step d), forwarding (step e) and moving (step f) steps for each one of said thermally transferable inks of said plurality; and (h) thereafter discharging said card past said exit-side transfer roller.

5. A method for thermally transferring a thermal transferable ink to a card having an effective printing area defined by front and rear ends, said method utilizing a printer comprising a thermal print head located at a print-starting point, and a driving unit including an entry-side transfer roller, a first capstan roller, a platen roller, a second capstan roller, a card sensor for detecting said card, and an exit-side transfer roller, said rollers being arranged along a transport passage, said method comprising the steps of:

defining an overrun stop point between said first capstan roller and said platen roller, based on a position of said card detected by said sensor, forwarding said card along said transport passage in a card-transporting direction, detecting said card thus forwarded, reversing said card until the front end of said effective printing area arrives at said overrun stop point, forwarding said card until said front end of said effective printing area arrives at said print-starting point, and further moving said card in the card-transporting direction until said rear end of said effective printing area passes through said print-starting point, while thermally transferring said thermally transferable ink to said card in such a state that said card is brought into contact with said thermal print head through said thermally transferable ink.

6. A method for printing images with a plurality of thermally transferable color inks on a card having an effective printing area defined by front and rear ends said method utilizing a printer comprising a thermal print head located at a print-starting point, and a driving unit including an entry-side transfer roller, a first capstan roller, a platen roller, a second capstan roller, a card sensor for detecting said card, and an exit-side transfer roller, said rollers being arranged along a transport passage, said method comprising the steps of:

(a) forwarding said card along said transport passage in a card-transporting direction, (b) detecting said card thus forwarded, (c) defining an overrun stop point between said first capstan roller and said platen roller, based on the position of said card detected by said sensor, (d) reversing said card until said front end of said effective printing area arrives at said overrun stop point, (e) forwarding said card until said front end of said effective printing area arrives at said print-staring point, (f) further moving said card until said rear end of said effective printing area passes through said print-starting point while thermally transferring a first one of said thermally transferable inks to said card as said card is brought into contact with said thermal head through one of said thermally transferable inks;

(g) sequentially repeating said reversing (step d), forwarding (step e) and moving (step f) steps for each one of said thermally transferable inks of said plurality; and (h) thereafter discharging said card past said exit-side transfer roller.

7. A device for thermally transferring at least one of thermal transferable printing inks, hologram films and a protective layer to a card having an effective printing area and a thickness, which comprises:

a card stacker for stacking one or more cards and feeding said one or more cards one by one along a transport passage, a thermal print head located at a printing position to which a card is transported from said card stacker in a card-transporting direction, a pair of entry-side transport rollers disposed beyond said card stacker, a driving unit for moving back and forth a card from said card stacker in said card-transporting direction, said driving unit including an entry-side first capstan roller, a first pinch roller opposite to said first capstan roller, a platen roller opposite to said thermal print head, an exit-side second capstan roller, a second pinch roller opposite to said second capstan roller, and a supporting frame having a horizontal portion on which platen, capstan and pinch rollers are retained, said supporting frame being provided with a cam follower and a spring for urging said platen and capstan rollers, and an actuating unit for rockingly moving said supporting frame to urge said platen roller against said thermal print head through said at least one of thermally transferable inks during printing, said entry-side transport rollers, first capstan roller, platen roller, second capstan roller, and exit-side transport roller being arranged in line along said transport passage.

8. A device according to claim 7, wherein said first and second pinch rollers are in resilient contact with said first and second capstan rollers, respectively.

9. A device according to claim 7, wherein said first and/or second capstan rollers are separated from said first and/or second pinch rollers by a distance smaller than the thickness of said card.

10. A device according to claim 7, wherein said first pinch roller is movably supported opposite to said first capstan roller so as to vary the distance between said first pinch roller and first capstan roller.

11. A device according to claim 10, wherein said first pinch roller is urged toward said first capstan roller by a spring whose tractive force is variable by rotating a cam wheel.

12. A device according to claim 10, wherein said first pinch roller is resiliently pressed against said first capstan roller and forced upward by a cam when said card enters into between said first pinch roller and said first capstan roller.

* * * * *